United States Patent [19]

Kennedy et al.

[11] 4,095,784

[45] Jun. 20, 1978

[54] TOY AIRCRAFT SYSTEM

[76] Inventors: Melvin Kennedy; Dietmar Nagel, both of 1675 York Ave., New York, N.Y. 10028

[21] Appl. No.: 739,072

[22] Filed: Nov. 5, 1976

[51] Int. Cl.[2] ..... A63H 27/04

[52] U.S. Cl. ..... 272/31 A

[58] Field of Search ..... 46/61, 74 R, 75, 76 R, 46/77; 272/31 A

[56] References Cited

U.S. PATENT DOCUMENTS

| | | | |
|---|---|---|---|
| 2,470,407 | 5/1949 | Murphy | 272/31 A |
| 3,696,558 | 10/1972 | Mabuchi et al. | 272/31 A |
| 3,731,424 | 5/1973 | Meyer | 46/77 |

FOREIGN PATENT DOCUMENTS

| | | | |
|---|---|---|---|
| 975,174 | 9/1975 | Canada | 272/31 B |

*Primary Examiner*—Louis G. Mancene

*Attorney, Agent, or Firm*—Amster & Rothstein

[57] ABSTRACT

A toy aircraft system with an aircraft powered by an electrically driven propeller and motor mounted in the aircraft which, in turn, is mounted on a boom which can rotate about a central point and move up and down in response to changes of the vertical position of the aircraft. The motor receives its electrical energy through the boom which consists of two side-by-side slim wires or rods, one of which is rotatable about its axis to tilt the aircraft forward and backward to guide the direction of flight of the aircraft.

8 Claims, 9 Drawing Figures

FIG. 7.
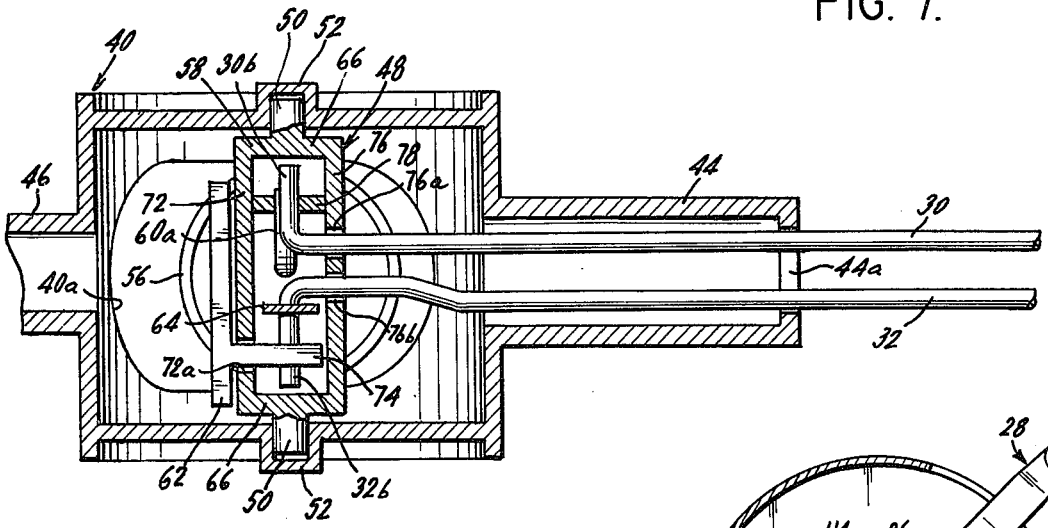
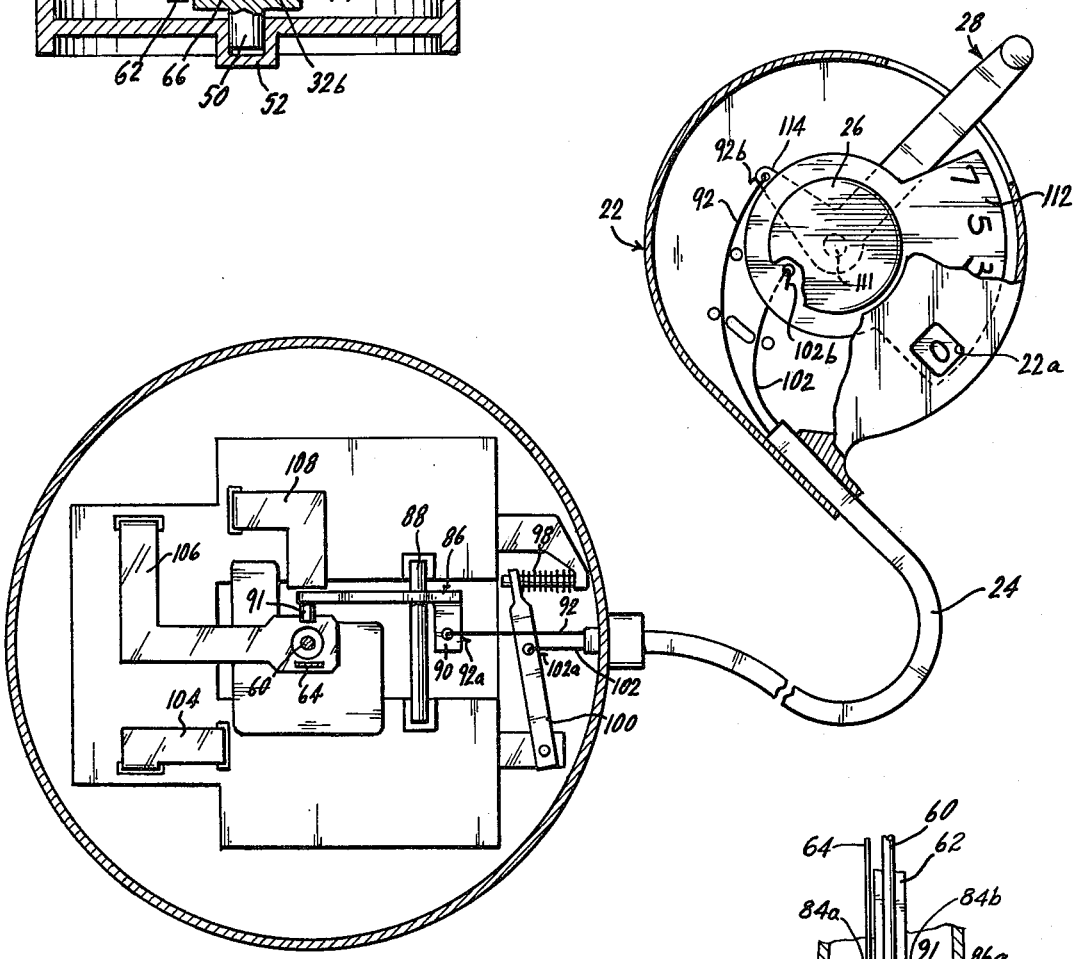
FIG. 8.
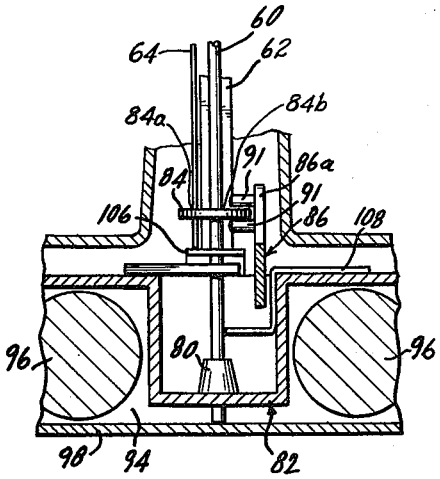
FIG. 9.

TOY AIRCRAFT SYSTEM

This invention relates generally to remotely operated toy vehicles, and more particularly concerns a toy system for simulating the flight of an aircraft.

Flying toys are well-known in the prior art. In a typical toy of this variety, a helicopter is mounted at the remote end of a flight boom which, in turn, is supported on a housing for rotational motion about the housing and pivotal motion in a vertical plane. The housing is adapted to be supported in an upright position on a surface such as a table or the floor so as to support the boom and aircraft above the surface. The aircraft has a propeller, and a motor is provided to drive the propeller through a flexible shaft which extends from the motor in the housing, through the boom and to the aircraft. As in a real helicopter, the propeller is normally disposed over the aircraft and, upon rotation, causes the aircraft to rise. Also, it is common for the helicopter to be rigidly mounted at the remote end of the boom. This provides for a stable mounting and permits the helicopter to be tilted about an axis extending along the boom by revolving the boom so that the rotating propeller tends to pull the craft in the direction of tilt.

Although toys have been available which simulate the flight of an aircraft, they possess a number of disadvantages undesirable in such devices. For example, it is very undesirable to couple the propeller to the motor through a flexible shaft. Such shafts, being moving parts, tend to wear and reduce the useful life of the toy, as well as its reliability of operation. Also, the shafts tend to kink easily so as to jam the motor and burn it out, or they may break at an early stage in the life of the toy. Even if the shaft functions properly, its inertial and frictional resistance to rotation represents an unnecessary additional load on the motor which, combined with the weight added to the boom by the shaft, may require an inordinately large and expensive motor for the size of the aircraft. At best, the noise of a high-speed flexible shaft is annoying. The complexity and expense of a flexible shaft coupling are unwarranted in simple toys and unduly reduce the reliability and increase the cost.

The rigid mounting of the aircraft to the flight boom is an additional disadvantage of existing flying toys. As a result of this rigid mounting, the propeller is banked toward the housing as the aircraft and boom rise. Consequently, the thrust of the propeller is not used efficiently, because its vertical component decreases as the aircraft rises above the horizontal. To overcome this problem, some prior art toys have been provided with a flight boom having a parallelogram construction. However, such a construction is unduly complex; it introduces additional moving parts and potential unreliability; and it unduly increases the expense of the toy.

Broadly, it is an object of this invention to eliminate the disadvantages of existing flying toys. Specifically, it is within the contemplation of the present invention to provide a simple toy aircraft system which does not require complex mechanical linkages between the aircraft and the motor or between the aircraft and the flight boom but which does provide a realistic action in the toy and significant play value.

It is another object of this invention to eliminate the flexible shaft coupling between the motor and propeller in a toy aircraft system.

It is yet another object of this invention to provide an aircraft system of the type described in which the aircraft is mounted to the flight boom so as to remain upright while rising or falling to different altitudes, which mounting does not require a complex mechanical linkage.

It is also an object of this invention to provide a toy aircraft system which is durable realistic in appearance, convenient and reliable in operation, amenable to mass production, but relatively simple and inexpensive in construction.

In accordance with an illustrative embodiment demonstrating objects and features of the present invention, there is provided a toy aircraft system having the general configuration already described. The electric motor for driving the propeller is located in the aircraft itself, and electric power is provided to the motor from the housing through a pair of thin, lightweight, metallic arms arranged in side-by-side relationship. These arms, one of which is called the aircraft control arm and the other the inactive arm, form part of the flight boom. Both arms are coupled to electrical batteries inside the housing. The control arm is mounted at its near end to the housing so as to be rotatable about an axis extending along its length, and the remote end of this arm is mounted to the aircraft so that the aircraft rotates with the arm, but pivots freely about an aircraft axis extending between the front and rear of the aircraft. The inactive arm is mounted at its near end to be free of rotation about an axis extending along its length, but is secured to the aircraft to permit the aircraft to rotate about the inactive arm and pivot with respect to the aircraft axis. The two arms are connected to the aircraft at a point above its center of gravity, so that the aircraft is suspended pendulously therefrom such that gravity tends to maintain the aircraft in an upright position. The arms are connected to the motor and function to deliver electrical power from the battery to the motor to energize it and to drive the propeller.

The foregoing brief description, as well as further objects, features and advantages of the present invention will be understood more completely from the following detailed description of a presently preferred, and illustrative, embodiment of the invention, with reference being made to the accompanying drawings wherein:

FIG. 7 is a sectional view, on an enlarged scale, taken substantially along line 7—7 in FIG. 5 and looking in the direction of the arrows;

FIG. 8 is a sectional view, on a reduced scale, taken substantially along line 8—8 and looking in the direction of the arrows in FIG. 5, and also includes a horizontal sectional view of the control panel for the system; and FIG. 9 is a fragmentary sectional view, on a reduced scale, taken substantially along line 9—9 in FIG. 5 and looking in the direction of the arrows.

Figure 1:
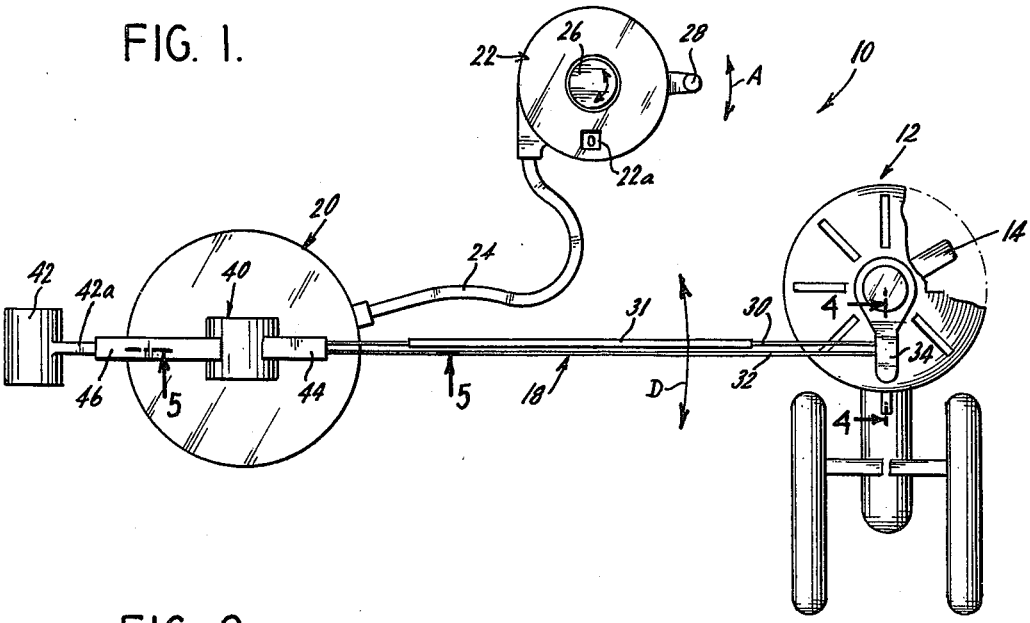
FIG. 1 is a top plan view showing a toy aircraft system embodying the invention.
Figure 2:
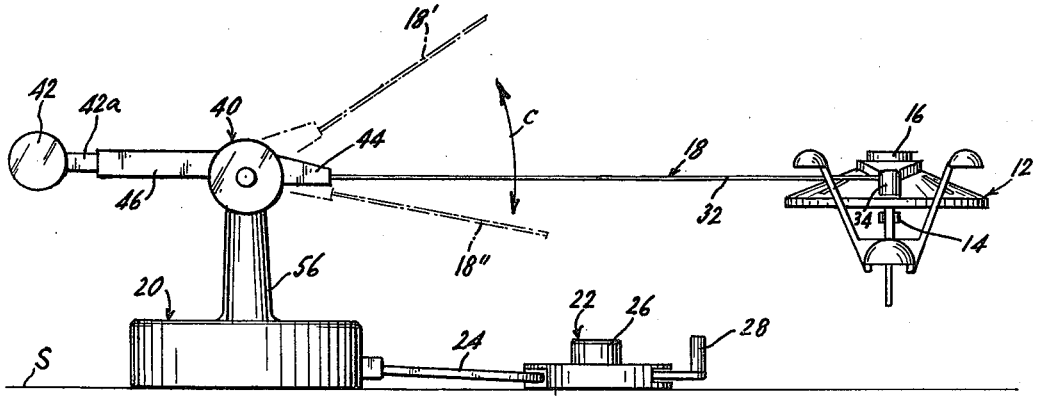
FIG. 2 is an elevational view of the system including a front elevational view of the aircraft system of FIG. 1, and illustrating the generally vertical pivotal movement of the flight boom.
Figure 3:
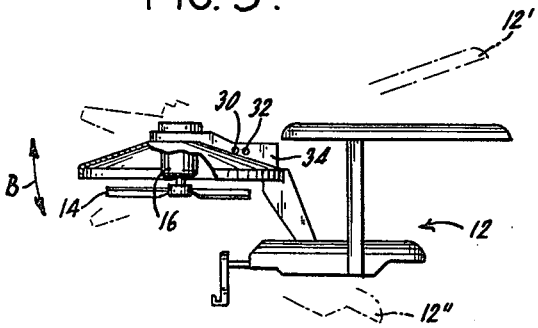
FIG. 3 is a left side elevational view of the aircraft and illustrates tilting movement of the aircraft.

Referring now to the details of the drawings, and in particular to FIGS. 1, 2, and 3, there is shown a toy aircraft system, indicated generally by the numeral 10, which system incorporates objects and features of the present invention. The sytem includes an aircraft 12 having a propeller 14 mounted to rotate with the drive shaft of an electric motor 16. The aircraft 12 is mounted at the remote end of a boom 18, which is mounted to a tower or housing 20 for rotation about a generally vertical system axis passing through the tower, and for pivotal movement in a generally vertical plane. The tower 20 is adapted to rest on a surface S and to support the aircraft 12 and the boom 18 above that surface. A control panel 22, which is coupled with the tower 20 through a cable 24, includes a rotatable speed control 26 and a direction control 28, both of which control the flight of the aircraft 12. The length of the cable 24 is greater than the length of the flight boom 18 such that the operator may be outside the circle described by the aircraft 12 when it rotates about the housing 20.

In using the toy, an operator rotates the knob 26 to vary the rotational speed of propeller 14 and moves the lever 28, as indicated by the double-headed arrow A in FIG. 1, to achieve tilting of the aircraft over a continuous range from a forward-tilted position 12′ to a rearwardly-tilted position 12″ (see the double-headed arrow B in FIG. 3). When the aircraft is not tilted (solid line position in FIG. 3), operating the speed control knob 26 to increase the propeller rotation speed causes the aircraft 12 to rise from a landed position (boom shown as 18″ in FIG. 2) toward a maximum altitude (boon shown as 18′ in FIG. 2). These altitude changes are achieved by virtue of the pivotal movement of boom 18 in a generally vertical plane as indicated by the double-headed arrow C in FIG. 2. If the aircraft 12 is tilted while propeller 14 is rotating, the aircraft will describe, about tower 20, either a counterclockwise orbit (if the aircraft is tilted to a position such as 12′) or a clockwise orbit (if the aircraft is tilted to a position such as 12″) as indicated by the double-headed arrow D in FIG. 1. By operating the speed control 26 and tilt control 28 simultaneously, the operator can cause the aircraft 12 to fly at various speeds and through orbital paths of varying height.

The aircraft 12 is preferably made of a light, durable material, such as plastic, and is designed to have an attractive futuristic appearance. The particular shape of the aircraft 12 here is patterned after the U.S.S. Enterprise of the television program Star Trek.

The propeller 14 and electric motor 16 are common components which are known and used in toy aircraft systems. Boom 18 includes component arms 30 and 32 made of stiff metal wire and have remote end portions 30*a* and 32*a*, respectively, which are bent at a right angle with respect to the axis of the arms and mounted to aircraft 12 inside ridge portion 34. The arms 30 and 32 enter portion 34 through appropriate openings formed in the side wall thereof. A single pronged lug 36, having an aperture 36*a* which is sized to receive portion 30*a* of arm 30, and a double-pronged lug 38, having aligned apertures 38*a* and 38*b* which are sized to receive portion 32*a* of arm 32, are secured within ridge portion 34 of aircraft 12 by conventional rivet means. Portion 30*a* of arm 30 is loosely received in aperture 36*a* so that lug 36 may tilt relative to the axis of portion 30*a* to allow the aircraft 12 to move as shown in FIG. 3. Portion 32*a* of arm 32 is received within apertures 38*a* and 38*b* only loosely enough to be journaled therein such that the axis of the openings 38*a* and 38*b* remains coincident with the axis of the arm portion 32*a*.

Figure 4:
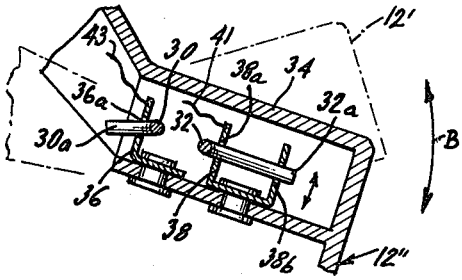
FIG. 4 is a fragmentary sectional view, on an enlarged scale taken along the line 4—4 of FIG. 1 looking in the direction of the arrows showing internal construction details of the aircraft of FIG. 3.

Arms 30 and 32 are made of a strong conductive material and are made as thin as possible consistent with providing adequate support for aircraft 12. These arms also couple electric power from within tower 20 to aircraft 12 as will be explained hereinafter. In order to prevent short circuiting the electric power, arm 30 is provided with an insulating sleeve 31. The lugs 36 and 38 are also conductive and serve to couple electric power from arms 30 and 32 to motor 16 via motor leads 43 and 41 respectively (see FIG. 4). As will be explained more fully hereinafter, arm 30 is mounted in tower 20 so that it does not rotate about its own axis whereas arm 32 is mounted in tower 20 to be actuable (via lever 28) to rotate about an axis extending along its length. As a result of this construction, when the arm 32 is rotated about its axis, portion 32*a* is swung through an arc and, by virtue of its connection to lug 38, carries the aircraft with it, thereby achieving the tilting of the aircraft as shown by arrow B of FIG. 3. Arm 30 is inactive and merely aids in supporting aircraft 12.

Because of the arms 30 and 32 are mounted to the aircraft at a point above its center of gravity and because the arm portions 30*a* and 32*a* are rotatably received in lugs 36 and 38, respectively, the aircraft is pendulously suspended from boom 18. The aircraft 12 therefore freely pivots with respect to the boom so as to continuously tend to assume an upright position regardless of the altitude of boom 18. As a result, the aircraft's flight is more stable and most efficient use is made of the thrusting force produced by propeller 14. When the aircraft 12 and boom 18 are moving continuously in circular orbit, centrifugal force will tend to make the aircraft 12 move radially outwardly. Because the aircraft is mounted on the arm portions 30*a* and 30*b* which are generally parallel to the front-to-rear axis of the aircraft, it can pivot on these arm portions and demonstrate a realistic banking movement.

In addition to the arms 30 and 32, boom 18 includes a pivoting support 40 and a countweight 42. Pivoting support 40 includes a front sleeve 44 having an aperture 44*a* adapted to receive the arms 30 and 32 loosely, and also has a rear sleeve 46 adapted to receive mounting arm 42*a* of weight 42. Sleeve 46 cooperates with arm 42*a* to permit it to be moved relative to the pivot point of the boom 18 and to be located at a plurality of different positions so as to accurately counterbalance the weight of aircraft 12 and boom 18. Pivoting support 40 has a bottom opening 40*a* which permits it to fit over the upper portion 56 of tower 20 and to pivot freely with respect thereto.

Figures 5, 6:
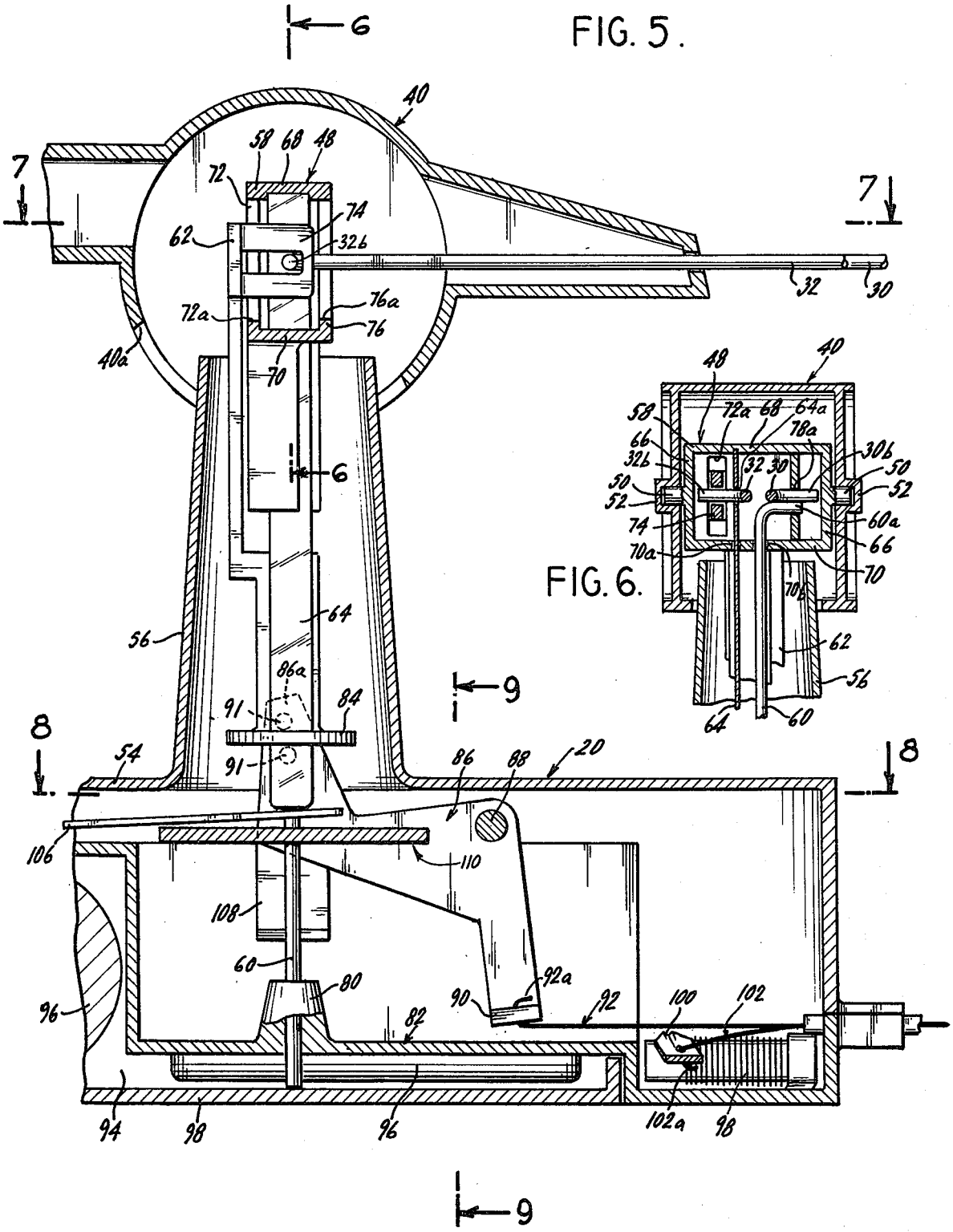
FIG. 5 is a front sectional view, on an enlarged scale, of the tower or housing portion of the system taken along the line 5—5 of FIG. 1 looking in the direction of the arrows showning internal construction details of the tower and flight boom.
FIG. 6 is a fragmentary sectional view, on an enlarged scale, taken substantially along line 6—6 and looking in the direction of the arrows in FIG. 5.

Within the tower 20 there is included an actuating assembly 48 which extends partially above the turret 56 of tower 20 and into pivoting support 40. As can be seen in FIG. 6, the portion of actuating assembly 48 extending into pivoting support 40 includes a pair of outwardly directed axles or mounting pins 50 on either side thereof. Pivoting support 40 includes bores 52 which accept the axles 50, so that pivoting support 40 can rotate about the axles 50 to provide the generally vertical pivotal movement of boom 18 (see arrow C of FIG. 2). As will be more fully explained hereinafter, actuating assembly 48 is mounted within base portion 54 of tower 20 for rotation about the vertical axis of the tower 20. By virture of its mounting to actuating assembly 48, pivoting support 40 rotates with actuating assembly 48 so that boom 18 carries the aircraft through an orbital path about the system axis (see arrow D of FIG. 1).

Actuating assembly 48 broadly comprises: a generally box-shaped, hollow coupling member 58; a vertical axle or shaft 60; an actuating link 62; and an electrically conductive elongated blade 64. Coupling member 58 is formed from an electrically non-conductive material such as plastic, and includes: a pair of spaced side walls 66 each having the above mentioned mounting pins to axles 50 on which the pivoting support 40 is mounted; an upper wall 68; a lower wall 70 having a slit **70*a* in which blade 64 is tightly received, and also including an aperture 70*b* in which axle 60 is tightly received (see FIG. 6); a rear wall 72 (see FIGS. 5 and 7) having a generally vertical slit 72*a* adapted to loosely receive a laterally projecting extension 74 on actuating link 62; a front wall 76 having two generally parallel vertical slits 76*a* and 76*b* adapted to loosely receive arms 30 and 32 respectively; and an internal wall 78 having an aperture 78*a* adapted to receive the 90° bent end 60*a* of axle 60 snugly and the end portion 30*b* of arm 30 loosely. Arms 30 and 32 pass through slits 76*a* and 76*b*, and their rear end portions 30*b* and 32*b* are bent to form a right angle with respect to the remainder of the arm. Portion 30*b* is received in aperture 78*a* and is thereby rotatable with respect to wall 78. The mounting of portion 32*b*** will be described more fully hereinafter.

Axle 60 is made of a strong conductive material, preferably steel. The lower end of axle 60 is journaled in a bearing 80 formed in supporting wall 82 inside the base 54 of tower 20, and extends through and below wall 82. Below wall 82, axle 60 is fastened against being withdrawn from bearing 80 by conventional means, such as a spring clip (not shown). The bottom of axle 60 rests against battery door 98, which acts as a thrust bearing. From bearing 80, axle 60 extends upwardly, through turret 56 and into coupling member 58 via aperture **70*b* in wall 70. The upper portion 60*a* of axle 60 is bent at a right angle with respect to the remainder of axle 60 and extends through inner wall 78 via aperture 78*a*, so that portion 30*b* of arm 30 rests on top of and is supported by portion 60*a* of axle 60. In effect, the entire actuating assembly 48 (and therefore boom 18) is supported on axle 60. From the foregoing description, it will be appreciated that axle 60 defines a generally vertical axis about which actuating member 48 (and therefore boom 18) rotates, and therefore defines the system axis about which the aircraft 12** orbits.

Actuating link 62 is made of a strong, electrically non-conductive material, preferably plastic. As best seen in FIG. 5, link 62 includes a generally horizontal disc-shaped guiding portion 84 at its lower end, and has the aforementioned extension 74 at its upper end, which extension projects laterally into coupling member 58 via slot **72*a*. Extending vertically therethrough, guiding portion 84 includes a slot 84*a* constructed to loosely receive blade 64 and an aperture 84*b* constructed to loosely receive axle 60, as best seen in FIG. 9. Extension 74 has a channel 74*a* extending therethrough which loosely receives portion 32*b* of arm 32. As a result of this construction and arrangement, actuating link 62 slides freely along and is guided by axle 60 and blade 64. The resultant vertical movement of extension 74 causes end portion 32*b* of arm 32 to be pivoted about the axis of arm 32 therefore moving the arm 32 about its axis and producing the tilting movement (arrows B) of the aircraft 12**.

Conductive blade 64 is secured within slit **70*a* of wall 70, and extends upwardly inside coupling member 58, downwardly through slot 84*a* in guiding portion 84 of link 62, and terminates at a point below guiding portion 84. Within coupling member 58, blade 64 has an aperture 64*a* which is generally aligned with channel 74*a* of extension 74 and which is dimensioned to loosely receive end portion 32*b* of arm 32. As a result of this construction and arrangement, blade 64 tends to restrain arm 32 against vertical movement. Thus, when extension 74 is displaced vertically as a result of actuating link 62 being moved, portion 32*b* is pivoted with the perimeter of aperture 64*a* of blade 64 acting as a fulcrum. As stated, the pivoting of portion 32*b* causes the arm 32 to be rotated about an axis extending along its length to produce forward and rearward tilting of aircraft 12**.

On the interior of hollow base portion 54 of tower 20, a lever member 86 is pivotably mounted on a shaft 88. The lever 86 has a coupling arm 90 and includes a pair of spaced pins 91 extending laterally from the face **86*a* of the lever member. As best seen in FIGS. 5 and 9, the pins 91 are arranged to straddle guiding member 84 of actuating link 62. A stiff but flexible wire 92 has its near end 92*a* coupled to arm 90, and its remote end 92*b* coupled to directional control lever 28 of control panel 22. When wire 92 is pushed and pulled, a force is exerted on arm 90 which causes lever member 86 to rotate about shaft 88. As a result, pins 91 move in a generally vertical direction and apply a force to guiding member 84 which causes actuating link 62 to be moved vertically and produces tilting of aircraft 12**.

In addition to the mechanical components described thus far, tower 20 includes an electrical system designed to provide electrical power to the motor 16 of aircraft 12. As may be seen in FIGS. 5 and 9, below the wall 82 of base portion 54, there is provided a compartment 94 which is constructed to house three electrical batteries 96. On the bottom of base portion 54 there is provided a removable door 98 which provides access to the compartment 94 and which is secured in place by conventional means (not shown). Referring now to FIGS. 8 and 9, it will be observed that the compartment 94 outlines the batteries 96 which are stored physically in a U-shaped array and are electrically in series. Between the two horizontally oriented (as viewed in FIG. 8) batteries, there are serially connected a resistive element 98 and a pivotally mounted conductive arm 100 which is slid over the surface of the resistive element 98 to vary the portion of the resistor in series with the two batteries as is well-known. The near end **102*a* of a stiff wire 102 is coupled to arm 100, and the remote end 102*b* of wire 102 is connected to speed control knob 26, so that operating the speed control knob causes wire 102 to push and pull arm 100, thereby adjusting the resistor just described. The third battery is connected in series with the circuit including the other two batteries and the variable resistor by means of a conductive strap 104**.

The series circuit including the three batteries and the variable resistor appears between conductive springs 106 and 108, each of which is connected to one of the, as yet, unconnected batteries. Spring 106 extends toward and beyond axis 60 to pass through without making contact. The weight of actuating assembly 48, boom 18 and aircraft 12 causes conductive blade 64 to bear down against spring 106 and to urge it towards an insulated supporting member 110. Blade 64 presses against spring 106 and continually maintains moving contact therewith as actuating assembly 48 rotates. Spring 108 extends downward, under lever member 86, and, therebelow, toward axle 60. Spring 108 is designed to exert a resilient force in the direction of axle 60, so that there is continuous contact with axle 60 as it rotates.

From the foregoing description it will be appreciated that the series circuit including the three batteries and the variable resistor is connected between blade 64 and axle 60 by means of the springs 106 and 108. Inside coupling member 58, blade 64 makes electrical contact with portion **32*b* of arm 32, and axle 60 makes electrical contact with portion 30*b* of arm 30. As a result, the series circuit including the three batteries and the variable resistor is actually connected in series with the motor 16 of aircraft 12 by means of the arms 30 and 32, the lugs 36 and 38, and the wires 41 and 43. Consequently, operating the speed control 26 varies the resistance in series with the batteries and the motor 16, so that the amount of current flowing to motor 14** and, therefore, the speed thereof can be controlled.

As can be seen in FIG. 8, control panel 22 includes a sturdy housing, which is preferably made of plastic and includes a window **22*a*. Speed control knob 26 and directional lever 28 are mounted for rotational movement about a common pivot pin 111. Knob 26 has a scale member 112 mounted to it which includes numbers. As knob 26 is rotated, one of the numbers on the member shows through window 22*a*. This allows the motor 16 of aircraft 12 to be operated at certain predetermined speeds corresponding to the numbers. Remote end 102*b* of wire 102 is connected to be pushed and pulled as speed control knob 26 is rotated, and this push and pull is coupled via wire 102 and through cable 24, which acts as a loose-fitting sheath for the wire, to arm 100**.

Lever 28 includes a laterally extending arm 114 to which is secured the remote end **92*b* of wire 92. As the lever is moved, wire 92 is pushed and pulled, and this push and pull is coupled via wire 92 to lever member 86, whereby the tilt of aircraft 12** is controlled, as previously described.

Although a specific embodiment of the invention has been disclosed for illustrative purposes, it will be appreciated by those skilled in the art that many additions, modifications and substitutions are possible without departing from the scope and spirit of the invention as disclosed in the accompanying claims. For example, tower 20 need not be made supportable on surface S. It could, instead, be supported or held upside down with an aircraft flying in an orbital path below it. Such an arrangement could also incorporate control panel 22 or the base portion of tower 20, so that the aircraft system 10 could be carried about while being operated.

What is claimed is:

1. A toy aircraft system comprising: a tower defining a system axis and including a source of electrical power; a flight boom having a remote end and a near end; pivot means for mounting said flight boom at said near end to said tower for rotation about said system axis for pivotal movement about an elevational axis, said flight boom including an aircraft control arm and an inactive arm; an aircraft mounted on said remote end of said control arm and said inactive arm and adapted for flight about said system axis, including a propeller for moving said aircraft and an electric motor mounted within said aircraft and connected to drive said propeller; said control arm and said inactive arm together supporting the weight of said aircraft and being electrically conductive to supply electricity from said tower to said aircraft; means for electrically connecting said control arm and said inactive arm to said source of electrical power; and means for electrically connecting said control arm and said inactive arm to said electric motor.

2. The toy aircraft system of claim 1 wherein said pivot means includes axle means defining said elevational axis and shaft means defining said system axis.

3. The toy aircraft system of claim 1 wherein said aircraft has a front, a rear, an aircraft axis extending therebetween, and a center of gravity and wherein said aircraft is pivotally connected to said remote end of said flight boom for movement about a pivot axis parallel to said aircraft axis with said center of gravity being located below said pivot axis such that said aircraft depends pendulously from said boom and is free to bank about said pivot axis.

4. The aircraft system of claim 3 wherein said control arm and said inactive arm are bent at right angles at said remote end of said boom and are received in apertures in said aircraft.

5. The aircraft system of claim 1 further comprising a counterweight attached to said flight boom at said near end and extending in a direction opposite to said remote end of said flight boom.

6. The aircraft system of claim 5 wherein said counterweight is adapted to be moved along said flight boom whereby said counterweight may be located at a plurality of positions relative to said tower.

7. The aircraft system of claim 1 wherein said control arm is adapted to be rotated about its own axis and further comprising means in said aircraft responsive to rotation of said control arm about its own axis for tilting said aircraft, and further comprising actuator means mounted on said tower and coupled to said control arm to rotate said control arm about its own axis, whereby said aircraft may be tilted to vary the orientation of said propeller and the direction of flight.

8. The aircraft system of claim 1 wherein said control arm and said inactive arm are arranged side by side in a horizontal direction.

* * * * *